US008341779B2

(12) United States Patent
Hornbach et al.

(10) Patent No.: US 8,341,779 B2
(45) Date of Patent: Jan. 1, 2013

(54) RETRACTABLE FOOT CASTER SUPPORTS

(75) Inventors: David W. Hornbach, Brookville, IN (US); Jonathan D. Turner, Dillsboro, IN (US); Jeffrey Scott Jelinek, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 3 days.

(21) Appl. No.: 12/960,960

(22) Filed: Dec. 6, 2010

(65) Prior Publication Data

US 2012/0137435 A1 Jun. 7, 2012

(51) Int. Cl.
*A47C 27/16* (2006.01)

(52) U.S. Cl. ..... 5/618; 5/611; 5/86.1

(58) Field of Classification Search ..... 5/600, 611, 5/618, 86.1

See application file for complete search history.

(56) References Cited

U.S. PATENT DOCUMENTS

| | | | | |
|---|---|---|---|---|
| 2,383,340 | A * | 8/1945 | Pezzano | 280/43.16 |
| 4,097,939 | A | 7/1978 | Peck et al. | |
| 4,592,104 | A | 6/1986 | Foster et al. | |
| 5,054,141 | A | 10/1991 | Foster et al. | |
| 5,117,521 | A | 6/1992 | Foster et al. | |
| 5,377,372 | A | 1/1995 | Rudolf et al. | |
| 5,454,126 | A | 10/1995 | Foster et al. | |
| 5,479,666 | A | 1/1996 | Foster et al. | |
| 5,708,997 | A | 1/1998 | Foster et al. | |
| 5,715,548 | A | 2/1998 | Weismiller et al. | |
| 5,806,111 | A | 9/1998 | Heimbrock et al. | |
| 5,878,452 | A | 3/1999 | Brooke et al. | |
| 5,933,884 | A | 8/1999 | Shikinami et al. | |
| 6,163,903 | A | 12/2000 | Weismiller et al. | |
| 6,321,878 | B1 | 11/2001 | Mobley et al. | |
| 6,351,861 | B1 | 3/2002 | Shows et al. | |
| 6,473,921 | B2 | 11/2002 | Brooke et al. | |
| 6,499,163 | B1 * | 12/2002 | Stensby | 5/618 |
| 6,658,680 | B2 | 12/2003 | Osborne et al. | |
| 6,669,224 | B2 | 12/2003 | Newkirk | |
| 6,718,580 | B2 | 4/2004 | Heimbrock et al. | |
| 6,751,815 | B2 | 6/2004 | Heimbrock et al. | |
| 6,865,775 | B2 | 3/2005 | Ganance | |
| 6,874,800 | B2 | 4/2005 | George | |
| 6,880,189 | B2 | 4/2005 | Welling et al. | |
| 6,957,461 | B2 | 10/2005 | Osborne et al. | |

(Continued)

FOREIGN PATENT DOCUMENTS

EP 2308442 A1 4/2011

(Continued)

OTHER PUBLICATIONS

European Search Report for Application No. 11192166.4-1257/2460504, dated Aug. 8, 2012, 8 pages.

*Primary Examiner* — Fredrick Conley
(74) *Attorney, Agent, or Firm* — Barnes & Thornburg LLP

(57) ABSTRACT

A bed has a head section and a foot section. The bed can assume a horizontal position and at least one position in which the foot section is at an angle relative to horizontal. For instance, the bed may assume a chair position, in which the head section is pivoted upwardly and the foot section is pivoted downwardly, to a substantially vertical position.

Casters allow the bed to move relative to the floor. The casters can retract toward the head section of the bed as the foot section pivots downwardly toward the floor.

20 Claims, 5 Drawing Sheets

U.S. PATENT DOCUMENTS

| | | | |
|---|---|---|---|
| 6,978,500 | B2 | 12/2005 | Osborne et al. |
| 6,993,799 | B2 | 2/2006 | Foster et al. |
| 7,014,000 | B2 | 3/2006 | Kummer et al. |
| 7,017,208 | B2 | 3/2006 | Weismiller et al. |
| 7,171,708 | B2 | 2/2007 | Osborne et al. |
| 7,237,287 | B2 | 7/2007 | Weismiller et al. |
| 7,273,115 | B2 | 9/2007 | Kummer et al. |
| 7,296,312 | B2 | 11/2007 | Menkedick et al. |
| 7,302,717 | B2 | 12/2007 | Reinke et al. |
| 7,346,942 | B2 | 3/2008 | Reinke et al. |
| 7,454,805 | B2 | 11/2008 | Osborne et al. |
| 7,480,948 | B2 | 1/2009 | Reinke et al. |
| 7,520,006 | B2 | 4/2009 | Menkedick et al. |
| 7,533,429 | B2 | 5/2009 | Menkedick et al. |
| 7,610,637 | B2 | 11/2009 | Menkedick et al. |
| 7,644,457 | B2 | 1/2010 | Hensley et al. |
| 7,644,458 | B2 | 1/2010 | Foster et al. |
| 7,698,760 | B2 | 4/2010 | Reckelhoff et al. |
| 2006/0026762 | A1 | 2/2006 | Hornbach et al. |

FOREIGN PATENT DOCUMENTS

| | | | |
|---|---|---|---|
| WO | 9109585 | A1 | 7/1991 |
| WO | 0051542 | A1 | 9/2000 |

* cited by examiner

RETRACTABLE FOOT CASTER SUPPORTS

BACKGROUND

This disclosure relates generally to movable patient beds. More particularly, this disclosure relates to patient beds that can assume a horizontal position and a position in which the foot section of the bed is at an angle relative to the horizontal.

Some patient beds, such as those commonly found in healthcare facilities and other locations in which health care is provided, have a number of features that may be operated by either a patient or a caregiver. One such feature allows the bed to move from a horizontal position to a chair position. Some examples of such patient beds are the TotalCare® Bed System and the VersaCare® bed, which are available from the Hill-Rom Company, Inc.

SUMMARY

The present invention comprises one or more of the features recited in the appended claims and/or the following features which, alone or in any combination, may comprise patentable subject matter.

According to one aspect of this disclosure, a bed includes a base, a frame supported by the base, and a deck supported by the frame. The deck supports a mattress. The deck has at least one deck section that is pivotable from a first position to a second position in which the deck section is at an angle relative to the base. The bed also includes casters supporting the base. The base has a first length extending along a longitudinal axis of the base, and a second length extending along the longitudinal axis of the base. The second length is shorter than the first length.

The base may have the first length when the deck section is in the first position and may have the second length when the deck section is in the second position. The deck may have a foot section configured to support at least a foot portion of a mattress, where the base has the first length when the foot section is in the first position and the base has the second length when the foot section is in the second position.

A foot end of the foot section may be spaced from the base by a first distance when the foot section is in the first position and the foot end of the foot section may be spaced from the base by a second distance when the foot section is in the second position. The second distance may be shorter than the first distance.

According to another aspect of this disclosure, a bed includes a base having a head end and a foot end spaced from the head end, and a deck supported by the base. The deck is configured to support a mattress. The deck includes a foot section adjacent the foot end of the base, where the foot section is movable from a substantially horizontal position to a substantially vertical position. The bed also includes a first caster supporting the head end of the base, and a second caster supporting the foot end of the base. The second caster is spaced from the first caster by a first distance along a longitudinal axis of the bed when the foot section is in the substantially horizontal position and spaced from the first caster by a second distance along the longitudinal axis of the bed when the foot section is in the substantially vertical position.

The first distance may be longer than the second distance. The bed may include first and second caster supports, where the first caster is coupled to the first caster support, the second caster is coupled to the second caster support, and the second caster support is movable relative to the first caster support along a longitudinal axis of the bed.

The second caster support may slide relative to the first caster support. The second caster support may retract toward the head end of the deck when the foot section is in the substantially vertical position and the second caster support may extend away from the head end of the deck when the foot section is in the substantially horizontal position.

According to a further aspect of this disclosure, a bed includes a base having a head end and a foot end spaced from the head end, and a deck supported by the base. The deck is configured to support a mattress. The deck includes an articulating foot section. The bed also includes a caster support coupled to the foot end of the base. The caster support is movable along a longitudinal axis of the bed between a first position and a second position spaced from the first position by a distance, where the distance is adjustable as the foot section articulates. The bed also includes a caster coupled to the caster support.

The bed may include an actuator coupled to the caster support, wherein the actuator is configured to extend and retract the caster support relative to the foot end of the base. The deck may be configured to assume a chair position and the actuator may be configured to retract the caster support when the deck assumes a chair position. The deck may be configured to assume a horizontal position and the actuator may be configured to extend the caster support when the deck assumes a horizontal position.

According to another aspect of this disclosure, a bed includes a plurality of casters, a base supported by the casters, the base having a head end, a foot end spaced from the head end, and an adjustable length, and a deck configured to support a mattress. The deck is supported by the base. The deck includes a foot section. The foot section is movable from a first position in which the foot section is substantially parallel to the base to a second position in which the foot section is at an angle relative to the base. The bed also includes a controller configured to change the length of the base if the foot section has moved.

The controller may be configured to decrease the length of the base if the foot section has moved to the second position. The controller may be configured to increase the length of the base if the foot section has moved to the first position. The bed may include a brake coupled to at least one of the casters, where the controller is configured to activate the brake after the length of the base is changed. The bed may include a foot end caster supporting the foot end of the base and a brake coupled to the foot end caster, where the controller is configured to release the brake before the length of the base is changed. The bed may include an input-output device coupled to the controller, wherein the controller is configured to receive a signal from the input-output device and change the length of the base in response to the signal.

BRIEF DESCRIPTION OF THE DRAWINGS

The detailed description particularly refers to the following figures, in which.

The same reference numbers may be used to refer to like components in the several drawings.

DETAILED DESCRIPTION

Figure 1:
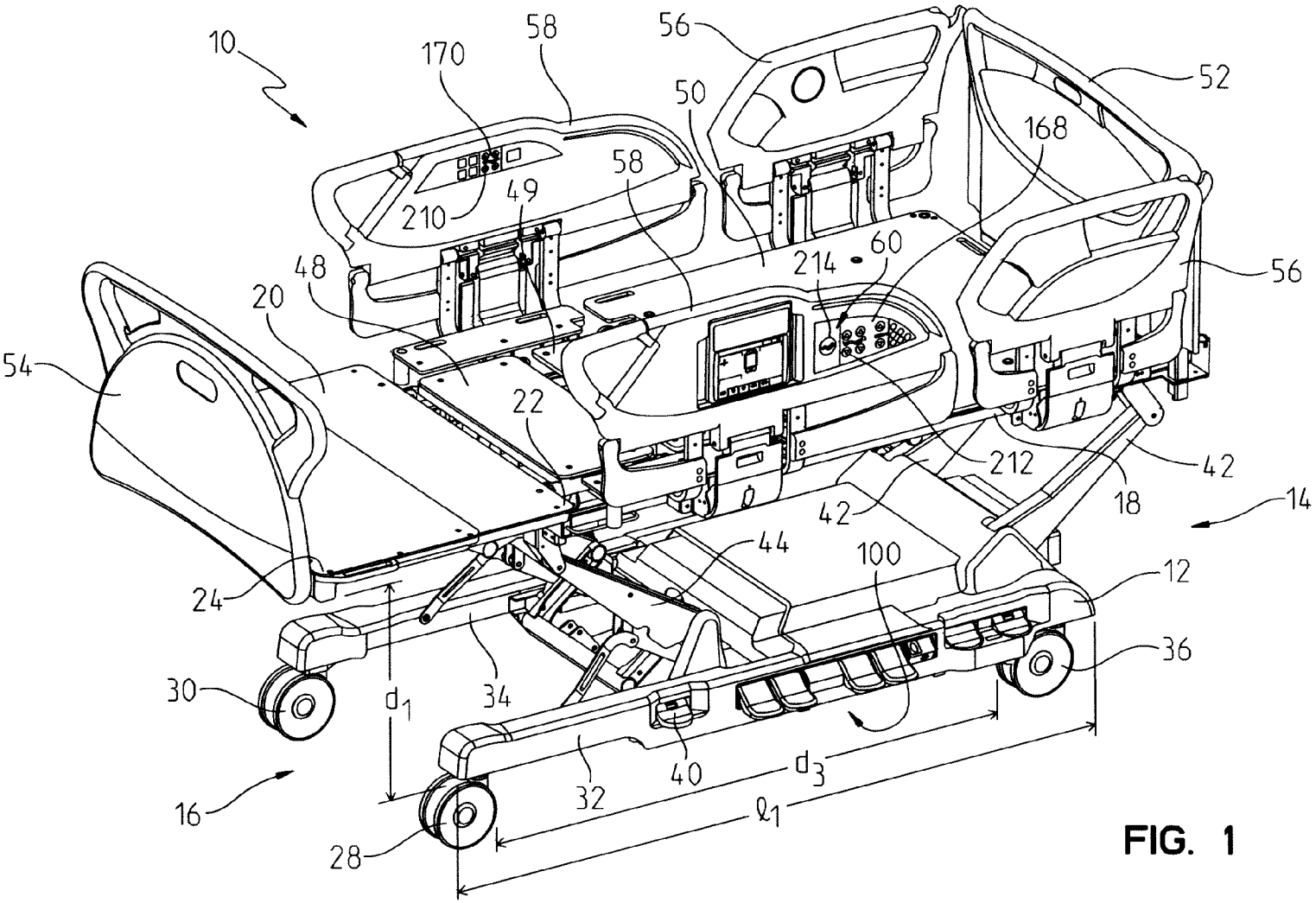
FIG. 1 is a perspective view of a bed in a horizontal position.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Figure 2:
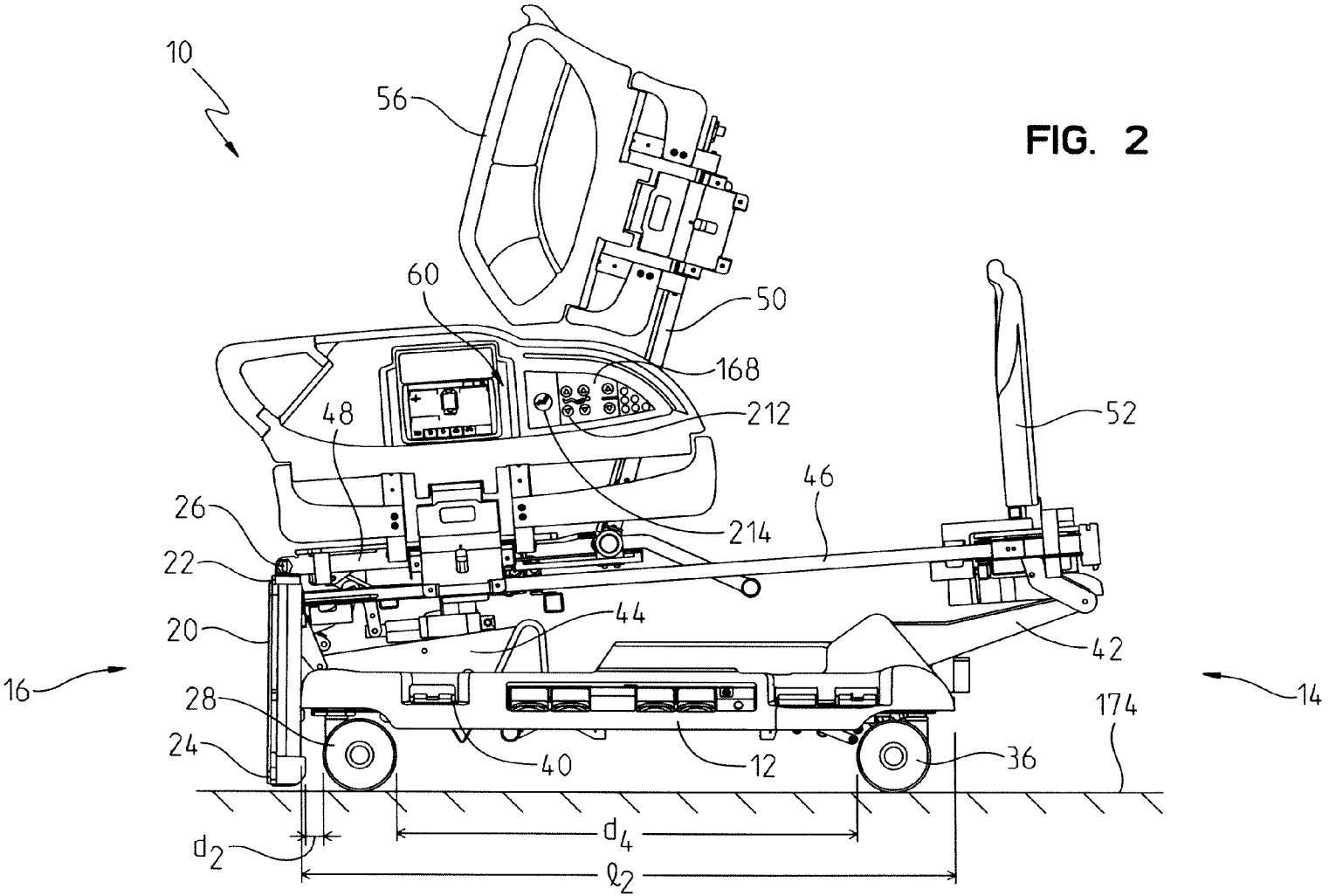
FIG. 2 is a side view of the bed of FIG. 1 in a chair position.

Referring to FIGS. 1-2, a bed 10 is shown. FIG. 1 shows the bed 10 in a flat or horizontal position, while FIG. 2 shows the bed 10 in a chair position. The bed 10 includes a base 12, which has a head end 14 and a foot end 16 spaced from the head end 14. The foot end 16 is spaced from the head end 14 by an adjustable distance $l_1$, $l_2$.

Figure 3:
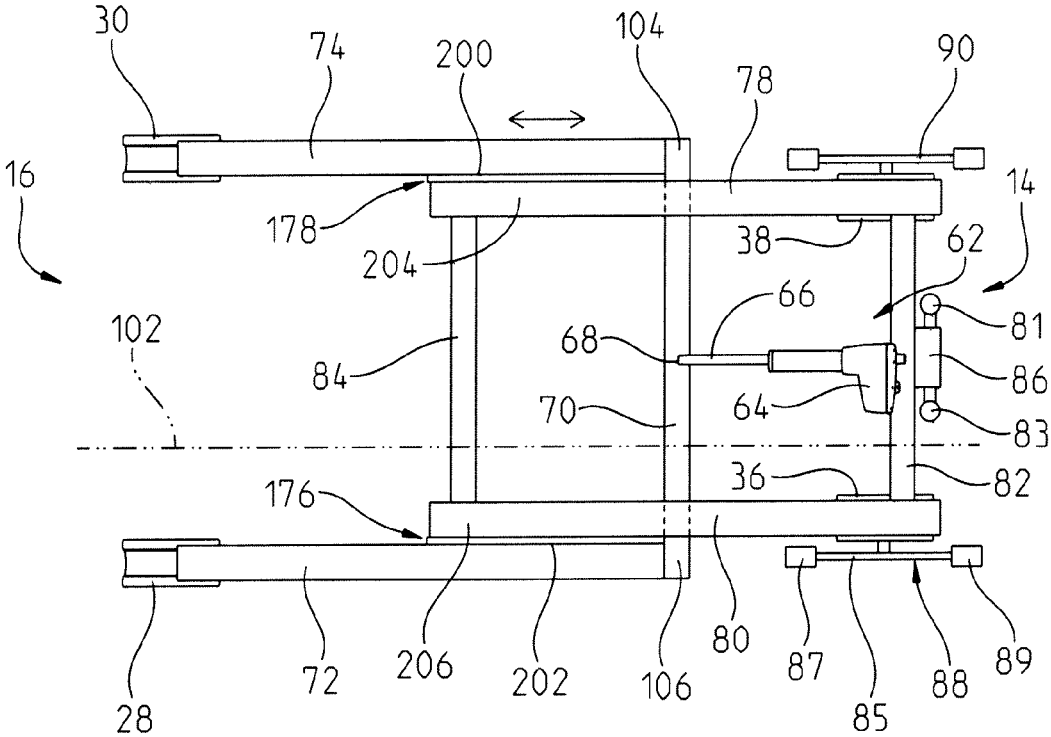
FIG. 3 is a top view of one version of an adjustable-length base for the bed of FIGS. 1 and 2.
Figure 4:
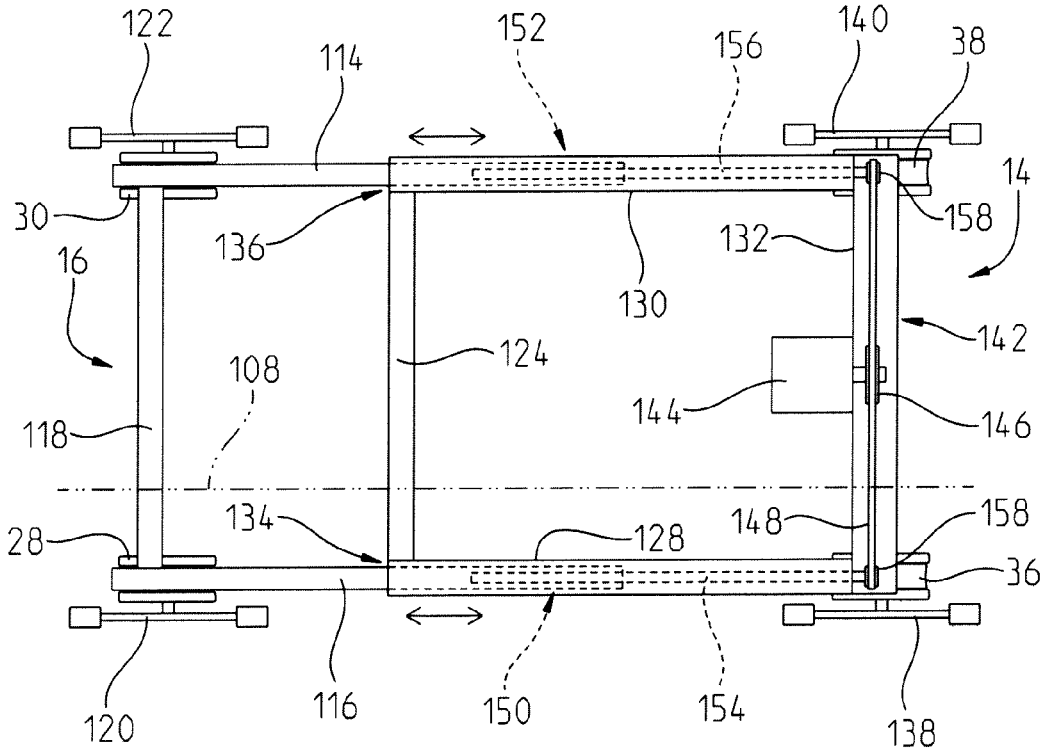
FIG. 4 is a top view of another version of an adjustable-length base for the bed of FIGS. 1 and 2.

The base 12 is supported by a pair of foot end casters 28, 30, and a pair of head end casters 36, 38. The casters 28, 30 are coupled to the base 12 near the foot end 16. The casters 36, 38 are coupled to the base 12 near the head end 14. The casters 28, 30 are spaced from the casters 36, 38 by an adjustable distance $d_3$, $d_4$. The casters 28, 30, 36, 38 each include one or more wheels that movably support the bed 10 relative to a floor or other surface 174, in one or more directions (e.g. forward and reverse). The base 12 and/or one or more of the casters 28, 30, 36, 38 may have an electronic or mechanically-controlled brake coupled thereto, as shown in FIGS. 3-4 and described below. Some examples of suitable casters and braking systems for beds are disclosed in U.S. Pat. Nos. 6,321,878; 6,473,921; 6,865,775; 6,874,800; 7,014,000; 7,302,717; 7,346,942; and 7,698,760.

A frame 46 is coupled to and supported by the base 12. A lift mechanism, which includes a pair of head end lift arms 42 and a pair of foot end lift arms 44, is configured to raise and lower the frame 46 relative to the base 12.

A deck 18 is coupled to and supported by the frame 46. The deck 18 is configured to support a mattress (not shown), which, in turn, may support a person positioned thereon. The deck 18 has a number of sections including, in the illustrated embodiment, a foot section 20, and a head section 50. The deck 18 also includes a torso section which, in the illustrated embodiment, includes a thigh section 48 and a seat section 49. In other embodiments, the torso section may include a single deck section (e.g. a seat/thigh section) rather than the two separate deck sections 48, 49.

At least the foot section 20 and the head section 50 are pivotable, such that the bed 10 may assume a number of positions other than a horizontal position, including a chair position in which the foot section 20 is pivoted downwardly toward the base 12 and the head section 50 is pivoted upwardly away from the frame 46. The foot section 20 has a proximal end 22, which is coupled to the thigh section 48 by a pivot 26. The foot section 20 also has a distal end 24, which is spaced from the foot end casters 28, 30 by an adjustable distance $d_1$, $d_2$.

The bed 10 has a number of foot pedals 100, including, in the illustrated embodiment, a brake pedal 40. The foot pedals 100 are coupled to and supported by the base 12. The foot pedals 100 may be used by a caregiver to change the position of the bed 10, activate or deactivate one or more of the caster brakes, or cause some other action to occur at the bed 10.

Typically, the bed 10 includes a number of siderails, such as opposing siderails 56 and opposing siderails 58, a headboard 52, and a footboard 54, as shown; however, all of these elements are not required for the purposes of the present disclosure.

One embodiment of the adjustable-length base 12 is shown in FIG. 3. In the embodiment of FIG. 3, the foot end 16 of the base 12 is movable relative to the head end 14 in a plane that is substantially parallel to a longitudinal axis 102 of the base 12. The foot end 16 includes a cross member 70, which extends across a width of the base 12. The cross member 70 has an end 104, to which a proximal end of a foot end caster support 74 is coupled. The cross member 70 has another end 106, which is laterally spaced from the end 104. A proximal end of a foot end caster support 72 is coupled to the end 106. The casters 28, 30 are coupled to distal ends of the foot end caster supports 72, 74, respectively. The casters 28, 30 are laterally spaced from each other by a distance defined at least in part by a length of the cross member 70.

In the embodiment of FIG. 3, the head end 14 of the base 12 includes cross members 82, 84, and a pair of head end caster supports 78, 80. The cross members 82, 84 are spaced from each other by a distance defined at least in part by a length of the head end caster supports 78, 80. The head end caster supports 78, 80 are spaced from each other by a distance at least in part defined by the length of the cross members 82, 84. The head end caster supports 78, 80 lie in a plane that is substantially parallel to the longitudinal axis 102. The caster 36 is coupled to a proximal end of the head end caster support 80, adjacent the cross member 82. Similarly, the caster 38 is coupled to a proximal end of the head end caster support 78, adjacent the cross member 82. The casters 36, 38 are laterally spaced from each other by a distance defined at least in part by a length of the cross member 82.

A number of brake pedals 86, 88, 90 are coupled to the head end 14 of the base 12. As illustrated, the brake pedal 86 has two opposing actuators 81, 83, one of which, when depressed, causes a brake mechanism connected thereto (not shown) to lower a brake pad to engage the floor, and the other of which, when depressed, causes the brake mechanism to release the brake pad from the floor. One example of a brake pad configured to engage the floor is shown in Hornbach et al., U.S. Patent Application Publication No. 2006/0026762.

Each of the brake pedals 88, 90 has two opposing actuators 87, 89 connected by a lever 85. One of the actuators 87, 89, when depressed, causes a brake mechanism connected thereto (not shown) to stop the rolling of the caster wheel or wheels, while the other actuator 87, 89, when depressed, causes the brake mechanism to stop the swiveling of the caster. When the lever 85 is in a horizontal position, the caster can roll and swivel freely. One example of such a brake mechanism is shown in Mobley et al., U.S. Pat. No. 6,321,878.

The brake pedal 86 is coupled to the cross member 82, while the brake pedals 88, 90 are coupled to the casters 36, 38. As described above, the brake pedals 86, 88, 90 are deployable to fix the position of the base 12 relative to the floor 174. For example, a force applied to an actuator or user control, such the brake pedal 40 or one or more of the brake pedal actuators 81, 83, 87, 89, may activate the braking mechanisms; while another force applied to the actuator or user control (e.g. the brake pedal 40 or one or more of the brake pedal actuators 81, 83, 87, 89) may release the braking mechanisms. Application and release of the brake pedals 86, 88, 90 is coordinated by a mechanical or electrical linkage (not shown), which may be connected to a bed controller 60.

Any suitable electrical or mechanical brake mechanism(s) may be used in place of those shown and described herein.

The head end caster supports 78, 80 movably support the cross member 70 of the foot end 16 of the base 12. The foot end caster supports 72, 74 and the head end caster supports 78, 80 are configured so that the foot end caster supports 72, 74 are movable relative to the head end caster supports 78, 80 in a longitudinal direction.

In the embodiment of FIG. 3, the foot end caster support 72 and the head end caster support 80 are coupled by a sliding linkage 176 that enables the foot end caster support 72 to slide relative to the head end caster support 80. Similarly, the foot end caster support 74 and the head end caster support 78 are coupled by a sliding linkage 178 that enables the foot end caster support 74 to slide relative to the head end caster support 78. In the embodiment of FIG. 3, the linkages 176, 178 each comprise a rail and channel configuration in which a channel is defined to slidingly support a rail therewithin.

In FIG. 3, a longitudinal channel 200, 202 is defined in each of the foot end caster supports 72, 74. Each channel slidingly receives a longitudinal rail 204, 206 of the corresponding head end caster support 78, 80. However, in other embodiments, the longitudinal rails 204, 206 may be located on the foot end caster supports 72, 74 and the longitudinal channels 200, 202 may be located on the head end caster supports 78, 80. Moreover, while FIG. 3 shows the channels 200, 202 located on inwardly facing sides of the foot end caster supports 72, 74 and the rails 204, 206 located on outwardly facing sides of the head end caster supports 78, 80, the sliding interface 200, 202, 204, 206 may involve top or bottom sides of the foot end caster supports 72, 74 and head end caster supports 78, 80 (e.g. the rails 204, 206 being located on bottom surfaces of the head end caster supports 78, 80 and the channels 200, 202 being defined in top surfaces of the foot end caster supports 72, 74, or vice versa). Also, the position of the foot end caster supports 72, 74 and the head end caster supports 78, 80 may be the reverse of the arrangement shown in FIG. 3 (e.g. the head end caster supports 78, 80 may be located adjacent the outwardly facing sides of the foot end caster supports 72, 74).

The sliding movement of the foot end caster supports 72, 74 is coordinated by the cross member 70, which slides relative to the head end caster supports 78, 80. Movement of the cross member 70 is driven by an actuator 62. In the embodiment of FIG. 3, the actuator 62 is a linear actuator driven by a motor 64, which is coupled to and supported by the cross member 82. The motor 64 extends and retracts a rod 66, the distal end 68 of which is coupled to the cross member 70. Extension of the rod 66 moves the foot end 16 (e.g. the cross member 70 and foot end caster supports 72, 74) in a longitudinal direction away from the cross member 82, increasing the length of the base 12 and increasing the distance between the foot end casters 28, 30 and the head end casters 36, 38. Retraction of the rod 66 moves the foot end 16 (e.g. cross member 70 and foot end caster supports 72, 74) toward the cross member 82 of the head end 14, shortening the length of the base 12 and shortening the distance between the foot end casters 28, 30 and the head end casters 36, 38. The motor 64 is coupled to the bed controller 60 by a suitable electrical linkage (not shown).

The operation of the actuator 62 is coordinated with the bed's braking system. For example, in the embodiment of FIG. 3, the controller is configured to check to make sure that the brakes controlled by the brake pedals 86, 88, 90 are deployed before the actuator 62 is actuated to extend or retract the length of the base 12.

FIG. 4 illustrates another version of the adjustable-length base 12, in which the foot end 16 is movable relative to the head end 14 in a plane that is parallel to a longitudinal axis 108 of the base 12. The foot end 16 includes a cross member 118, which extends across a width of the base 12. A pair of spaced-apart foot end caster supports 114, 116 are coupled to opposite ends of the cross member 118. The casters 28, 30 are coupled to the foot end caster supports 114, 116, respectively. The casters 28, 30 are laterally spaced from each other by a distance defined at least in part by a length of the cross member 118. Brakes 120, 122 are coupled to the casters 28, 30, respectively.

In the embodiment of FIG. 4, the head end 14 of the base 12 includes cross members 124, 132, and a pair of head end caster supports 128, 130. The cross members 124, 132 are spaced from each other by a distance defined at least in part by a length of the head end caster supports 128, 130. The head end caster supports 128, 130 are spaced from each other by a distance defined at least in part by a length of the cross members 124, 132, and lie in a plane that is substantially parallel to the longitudinal axis 108.

The caster 36 is coupled to a proximal end of the head end caster support 128, adjacent the cross member 132. Similarly, the caster 38 is coupled to a proximal end of the head end caster support 130, adjacent the cross member 132. The casters 36, 38 are laterally spaced from each other by a distance defined at least in part by a length of the cross member 132.

The foot end caster support 114 and a distal end of the head end caster support 128 are coupled by a sliding linkage 150 that enables the foot end caster support 114 to slide relative to the head end caster support 128. Similarly, the foot end caster support 116 and a distal end of the head end caster support 130 are coupled by a sliding linkage 152 that enables the foot end caster support 116 to slide relative to the head end caster support 130. In the embodiment of FIG. 4, the linkages 150, 152 each comprise a longitudinal channel 134, 136, which is defined within the interior of the head end caster supports 128, 130. The channels 134, 136 are defined to slidingly receive and support a portion of the foot end caster supports 114, 116 therewithin in a telescoping fashion, so that a portion of the foot end caster supports 114, 116 slides into and out of the corresponding head end caster supports 128, 130 to change the length of the base 12. It will be understood, however, that the channels 134, 136 may instead be located in the foot end caster supports 114, 116 so that a portion of the head end caster supports 128, 130 slides into and out of the corresponding foot end caster support 114, 116.

The sliding movement of the foot end caster supports 114, 116 is coordinated by the cross member 118. Movement of the foot end caster supports 114, 116 is driven by an actuator 142. In the embodiment of FIG. 4, the actuator 142 includes a motor 144. The motor 144 is coupled to the bed controller 60 by a suitable electrical linkage (not shown). The motor 144 drives a gear train that includes a central gear or pulley 146, which drives a pair of side gears or pulleys 158 via a chain or belt 148. Rotation of the side gears or pulleys 158 rotates corresponding acme or ball screws 154, 156. The screws 154, 156 threadingly engage inner threaded surfaces of the foot end caster supports 114, 116 to extend and retract the foot end caster supports 114, 116 relative to the head end caster supports 128, 130.

Rotation of the gears or pulleys 146, 158 in one direction moves the foot end 16 (e.g. the cross member 118 and foot end caster supports 114, 116) in a longitudinal direction away from the cross member 124, increasing the length of the base 12 and increasing the distance between the foot end casters 28, 30 and the head end casters 36, 38. Rotation of the gears or pulleys 146, 158 in the opposite direction moves the foot end 16 (e.g. cross member 118 and foot end caster supports 114, 116) toward the cross member 124 of the head end 14, shortening the length of the base 12 and shortening the distance between the foot end casters 28, 30 and the head end casters 36, 38.

The bed 10 has a number of electronically controlled functions, which may be activated or deactivated by a patient or caregiver using an input-output device, such as one of the foot pedals 100, a patient input-output device 170, or a caregiver input-output device 168.

The patient input-output device 170 receives and processes electrical input (e.g. voltage) from number of manually operable controls (such as membrane switches, keys, dials, levers, or the like) coupled to the patient input-output device 170, which enable a patient to activate and deactivate certain bed functions when the patient is positioned on the bed 10. For example, some beds permit the patient to raise and lower the bed or change the position of certain sections thereof by touching these controls. The illustrated patient input-output device 170 includes a control 210, which enables the patient to lower the foot section 20 of the deck 18.

The patient input-output device 170 includes circuitry configured to convey voltage generated by the manually operable controls, including the control 210, to the bed controller 60, described below. In the illustrated embodiment, a patient input-output device 170 is mounted to the inwardly facing side of at least one of the siderails 58 of the bed 10 (i.e., facing toward the mattress), but the patient input-output device 170 may be placed in any suitable location that is accessible to a person positioned on the bed 10.

A caregiver input-output device 168 receives and processes electrical input (e.g. voltage) from one or more controls mounted thereto, which enable a caregiver to configure, activate and/or deactivate certain of the electronically controlled bed functions. For example, some beds permit the caregiver to raise and lower the bed or change the position of certain sections thereof, to achieve a chair, CPR, Trendelenburg, or reverse Trendelenburg position, for example, by physically contacting the selected control. The illustrated caregiver input-output device 168 includes a control 212, which enables the caregiver to lower the foot section 20 of the deck 18, and a control 214, which enables the caregiver to place the bed 10 into a chair position in which the head section 50 is elevated and the end 24 of the foot section 20 is rotated downwardly toward the floor 174.

Typically, the controls of the caregiver input-output device 168 include manually operable controls, such as membrane switches, keys, dials, levers, or the like. Some caregiver input-output devices have touchscreen displays, which may include a graphical user interface. The caregiver input-output device 168 includes circuitry configured to convey voltage generated by the controls mounted thereto to the bed controller 60, described below. In the illustrated embodiment, a caregiver input-output device 168 is mounted to the outwardly facing side of at least one of the siderails 58 of the bed 10 (i.e., facing away from the mattress), but the caregiver input-output device 168 may be placed in any suitable location that is accessible to a caregiver.

Figure 5:
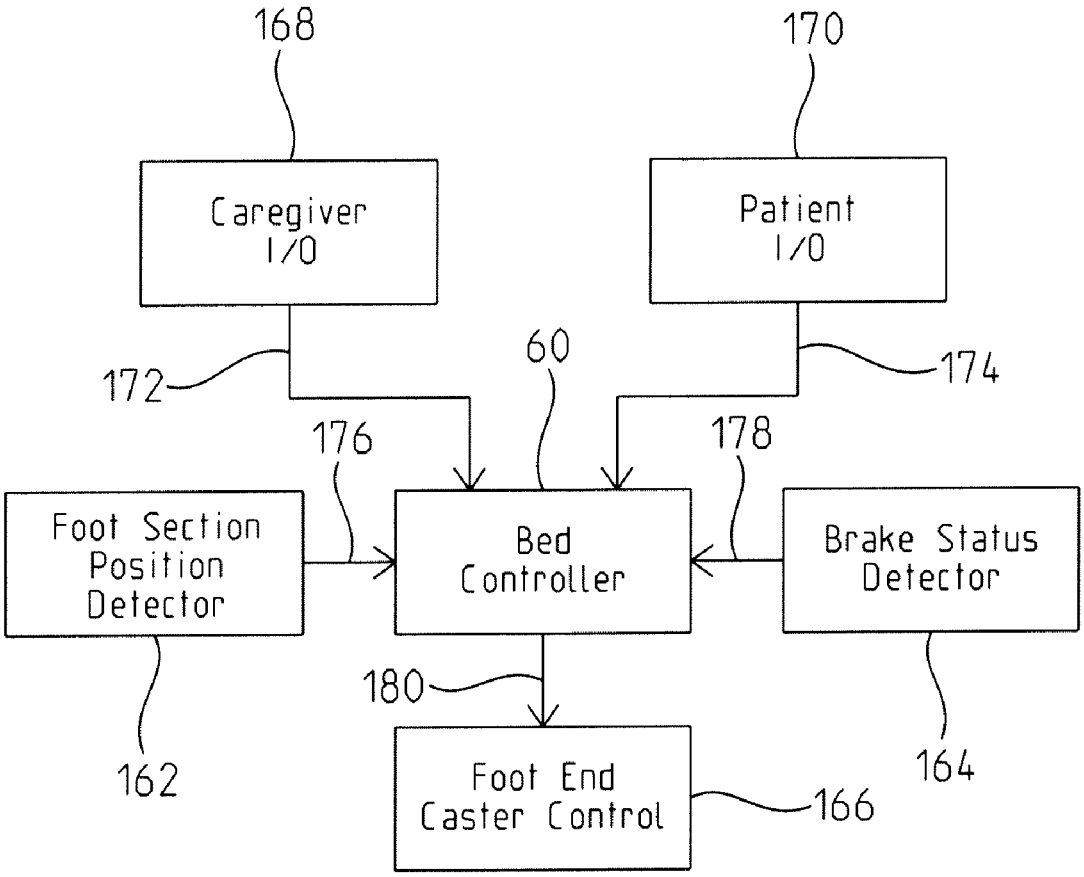
FIG. 5 is a block diagram of a bed control system.

Referring to FIG. 5, electronically-controlled functions of the bed 10 are managed by the bed controller 60. The bed controller 60 includes one or more microprocessors or microcontrollers and electrical circuitry located in a housing that is mountable to the bed 10. In the illustrated embodiment, the bed controller 60 is located between the inwardly facing and outwardly facing sides of each of the siderails 58, so that the patient input-output device 170 and the caregiver input-output device 168 are connected to opposite sides of the bed controller 60. However, the bed controller 60 may be placed in any suitable location on the bed. The location of the bed controller 60 relative to the bed 10 is not important for the purposes of the present disclosure.

The bed controller 60 receives electrical input from other bed modules or devices, including the caregiver input-output device 168, the patient input-output device 170, a foot section position detector 162, and a brake status detector 164, via one or more electrical signal paths 172, 174, 176, 178, 180. The signal paths 172, 174, 176, 178, 180 may include wired or wireless connections, or may be connected to an electronic bed network, which may be configured according to a Controller Area Network (CAN) protocol, an Echelon protocol, or another suitable electronic communications protocol.

Among other things, the bed controller 60 processes inputs from the modules 162, 164, 168, 170, and executes computer logic to determine whether the length of the base 12 needs to be adjusted. In the illustrated embodiments, adjusting the length of the base 12 involves changing the position of the foot end caster supports (e.g. 32, 34, 78, 80, 114, 116). If the length of the base 12 is to be adjusted, the bed controller 60 sends a control signal to a foot end caster control module 166 to cause the base 12 to lengthen or shorten, as the case may be.

In determining whether the length of the base 12 is to be adjusted, the bed controller 60 reviews foot section position information provided by the foot section position detector 162. In the illustrated embodiment, the foot section position detector 162 includes a potentiometer coupled to the foot section 20, which sends a voltage output to the bed controller 60 when the angle of the foot section relative to the horizontal has changed. However, the foot section position detector 162 may include any suitable device for monitoring the position or angle of the foot section relative to the base, including an accelerometer, inclinometer, proximity sensor, or the like.

Also, the foot section position detector 162 may be incorporated into the actuator, linkage or other mechanism that causes rotation of the foot section 20. For example, the foot section position detector 162 may include a potentiometer, Hall sensor, Hall potentiometer, linear potentiometer, or the like, which is coupled to a linear actuator that has a housing mounted to the base 12 or the frame 46. The linear actuator includes a rod, which has a proximal end coupled to the housing and a distal end coupled to the foot section 20. The rod extends and retracts to change the angle of the foot section 20 relative to the horizontal. In this case, the foot section position detector 162 may be configured to detect changes in the length of the rod in order to determine the position of the foot section 20.

If the angle of the foot section 20 is in the range of about zero degrees, plus or minus a tolerance, relative to the horizontal, the foot section 20 is considered to be in the "up" or horizontal position. If the angle of the foot section 20 is in the range of about ninety degrees, plus or minus a tolerance, relative to the horizontal, then the foot section 20 is considered to be in the "down" or vertical position.

In one embodiment of the bed 10, a rotary potentiometer is mounted to the frame 46 of the bed 10, and the foot section position detector 162 monitors the angle of the foot section 20 relative to the frame 46. When the foot section 20 pivots relative to the frame 46, a mechanical link coupled to the foot section 20 pivots. A lever coupled to the mechanical link also pivots. This lever is coupled to an input shaft of the potentiometer, so that when the lever pivots, the input shaft of the potentiometer turns. Turning of the input shaft rotates the drive wheel of the potentiometer.

Rotation of the drive wheel causes a change in the voltage output of the potentiometer. The foot section position detector 162 detects the voltage change and sends the voltage output to the bed controller 60. The bed controller 60 correlates the voltage change with an angular measurement of the foot section 20 relative to the frame 46. If the frame 46 is at an angle relative to the horizontal (e.g. by action of the hi-lo system, described below), then the bed controller 60 converts the angular measurement of the foot section 20 relative to the frame 46 to an angular measurement relative to the horizontal using the information derived from position detectors associated with the hi-lo system.

The bed 10 has position detectors (e.g. rotary potentiometers) associated with the hi-lo system, which raises, lowers, and tilts the frame 46 relative to the base 12. The hi-lo system includes the lift arms 42, 44, which are driven by hi-lo actuators (not shown), such as linear actuators or hydraulic cylinders. When the frame 46 is tilted relative to the base 12 (e.g. to place the bed 10 in a Trendelenburg or Reverse Trendelenburg position), the tilt angle of the frame 46 relative to the base 12 may be determined from the activity of the hi-lo actuators. The bed controller 60 detects and compares changes in the voltage output of the potentiometers associated with the hi-lo actuators and correlates the relative changes with an angular measurement of the frame 46 relative to the base 12.

The bed controller 60 executes computer logic to determine the angle of the foot section 20 relative to the horizontal. The bed controller 60 also executes computer logic to determine whether the angle of the foot section 20 relative to the horizontal is within a range that requires extension or retraction of the foot section caster supports (e.g. 32, 34, 78, 80, 114, 116).

Some embodiments of the bed 10 may use other means of determining the position of the foot section 20 relative to the base 12. For instance, a proximity sensor may be installed on the distal end 24 of the foot section 20 and/or one or more of the foot end caster supports 32, 34 and/or one or more of the foot end casters 28, 30. In this case, the bed controller 60 receives output from the proximity sensor and executes computer logic to determine the distance between the distal end 24 of the foot section 20 and the base 12. The bed controller 60 also executes computer logic to determine whether such distance is within a range that requires extension or retraction of the foot section caster supports (e.g. 32, 34, 78, 80, 114, 116). In the illustrated embodiment, the minimum distance between the end 24 of the foot section 20 and the foot end casters 28, 30 is in the range of about 25 mm. Thus, if the distance between the distal end 24 of the foot section 20 and the foot end casters 28, 30 is in the range of about 25 millimeters, plus or minus a tolerance, then the foot section caster supports (e.g. 32, 34, 78, 80, 114, 116) may be retracted.

If the length of the base 12 is to be adjusted, the bed controller 60 reviews signals from the brake status detector 164. The brake status detector 164 includes a sensor or switch (such as a binary switch) that is coupled to the brakes and issues an output signal when the status of one or more of the brakes controlled by the brake pedals (e.g. 86, 88, 90, 120, 122, 138, 140) changes. For example, the brake status detector 164 may include a switch that closes when the brakes controlled by the brake pedals (e.g. 86, 88, 90, 120, 122, 138, 140) are applied. The bed controller 60 processes the brake status information from the brake status detector 164 and applies or releases the brake pedals (e.g. 86, 88, 90, 120, 122, 138, 140) as needed prior to and/or after adjusting the length of the base 12.

If the inputs from the foot section position detector 162 and the brake status detector 164 indicate to the bed controller that the length of the base 12 is to be adjusted, then the foot end caster control module 166 determines whether the length of the base 12 is to be extended or retracted, and sends a control signal to the actuator motor (e.g. 64, 144) to cause the appropriate extension or retraction. In the embodiment of FIG. 3, the control signal issued by the foot end caster control module 166 causes the rod 66 to extend or retract, as needed. In the embodiment of FIG. 4, the control signal issued by the foot end caster control module 166 causes the motor 144 to rotate the screws 154, 156 in one direction or the other, as needed.

It will be understood that the logic and processes identified herein as being part of the caregiver input output device 168, the patient input output device 170, the foot section position detector 162, the brake status detector 164, and the foot end caster control module 166 may be included in the bed controller 60 or may be implemented as one or more separate modules that are in communication with the bed controller 60.

Figure 6:
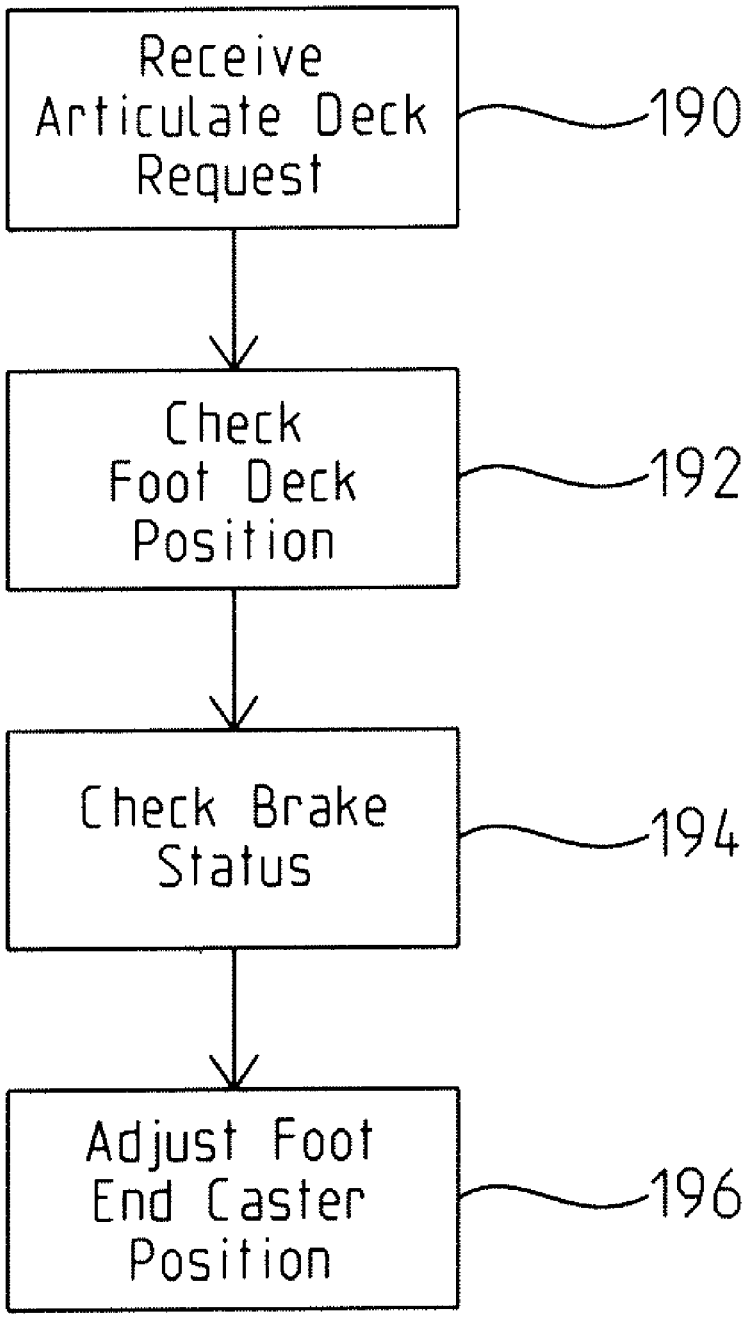
FIG. 6 is a flow diagram illustrating processes that may be executed by the bed control system of FIG. 5.

FIG. 6 illustrates steps or routines of a process that may be implemented using computer programming and executed by the foot end caster control 166 (and/or the bed controller 60) to adjust the length of the base 12. A routine 190 receives a request to change the orientation (or "articulate") the deck 18, in the form of an electrical signal. The request may originate at the caregiver input output device 168 or the patient input output device 170, as described above. The routine 190 determines, based on a characteristic of the electrical signal (such as a voltage output), whether the requested change in orientation of the deck 18 involves a change in the orientation of the foot section 20. For example, if the request is generated as a result of one of the user controls 210, 212, 214 being activated, or if the bed 10 is placed in the Trendelenburg or Reverse Trendelenburg position, the foot section 20 will be oriented at an angle relative to the horizontal. In particular, the routine 190 identifies when the angle of the foot section 20 is below the horizontal.

The routine 192 monitors the position of the foot section 20 using output from the foot section position detector 162 to determine whether the position of the foot section 20 requires an adjustment to the length of the base 12. For example, if the angle of the foot section 20, relative to the horizontal, comes within a range of about 90 degrees, plus or minus a tolerance, below horizontal, or if the distance between the end 24 and the casters 28, 30 comes within a range of about 25 millimeters, plus or minus a tolerance, then the routine 192 initiates the foot end caster control 166.

The routine 194 monitors the status of the brakes (e.g. 86, 88, 90, 120, 122, 138, 140), using output from the brake status detector 164. In the embodiment of FIG. 3, the process continues to routine 196 if the brakes 86, 88, 90 are applied. In the embodiment of FIG. 4, the process continues to routine 196 if the foot end brakes 138, 140 are not applied and the brakes 120, 122 are applied.

Once the brakes are set in their proper position for adjustment of the length of the base 12, the routine 196 initiates adjustment of the length of the base 12 by extending or retracting the foot end caster supports (e.g. 32, 34, 72, 74, 114, 116) as needed. For instance, if the routine 192 determines that the foot section 20 is in an up or horizontal position or moving toward an up or horizontal position, then the routine 196 initiates extending the foot end caster supports (e.g. 32, 34, 72, 74, 114, 116), by sending a control signal to a motor 64, 144, for example, to increase the length of the base 12. If the routine 192 determines that the foot section 20 is in a down or vertical position or moving toward a down or vertical position, then the routine 196 initiates retracting the foot end caster supports (e.g. 32, 34, 72, 74, 114, 116), by sending a control signal to a motor 64, 144, for example, to shorten the length of the base 12.

There are many advantages of the present disclosure arising from the various features described herein. It will be noted that alternative embodiments of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A bed, comprising a base, a frame supported by the base, a deck supported by the frame, the deck being configured to support a mattress, the deck including at least one deck section being pivotable from a first position to a second position in which the deck section is at an angle relative to the base, and a plurality of casters supporting the base, the base having a first length extending along a longitudinal axis of the base and a second length extending along the longitudinal axis of the base, the second length being shorter than the first length, and the base being substantially parallel to the longitudinal axis of the bed when the base has the first length and when the base has the second length.

2. The bed of claim 1, wherein the base has the first length when the deck section is in the first position and the second length when the deck section is in the second position.

3. The bed of claim 2, wherein the at least one deck section includes a foot section configured to support at least a foot portion of a mattress, wherein the base has the first length when the foot section is in the first position and the base has the second length when the foot section is in the second position.

4. The bed of claim 3, wherein a foot end of the foot section is spaced from the base by a first distance when the foot section is in the first position and the foot end of the foot section is spaced from the base by a second distance when the foot section is in the second position.

5. The bed of claim 4, wherein the second distance is shorter than the first distance.

6. A bed, comprising a base having a head end and a foot end spaced from the head end, a deck supported by the base, the deck being configured to support a mattress, the deck including a foot section adjacent the foot end of the base, the foot section being movable from a substantially horizontal position to a substantially vertical position, a first caster supporting the head end of the base, and a second caster supporting the foot end of the base, the second caster being spaced from the first caster by a first distance along a longitudinal axis of the bed when the foot section is in the substantially horizontal position and spaced from the first caster by a second distance along the longitudinal axis of the bed when the foot section is in the substantially vertical position, and the foot end of the base being substantially parallel to the longitudinal axis of the bed when the base has the first length and when the base has the second length.

7. The bed of claim 6, wherein the first distance is longer than the second distance.

8. The bed of claim 6, comprising first and second caster supports, wherein the first caster is coupled to the first caster support, the second caster is coupled to the second caster support, and the second caster support is movable relative to the first caster support along a longitudinal axis of the bed.

9. The bed of claim 8, wherein the second caster support slides relative to the first caster support.

10. The bed of claim 8, wherein the second caster support retracts toward the head end of the deck when the foot section is in the substantially vertical position and the second caster support extends away from the head end of the deck when the foot section is in the substantially horizontal position.

11. A bed, comprising a base having a head end and a foot end spaced from the head end, a deck supported by the base, the deck being configured to support a mattress, the deck including an articulating foot section, a caster support coupled to the foot end of the base, the caster support being movable along a longitudinal axis of the bed between a first position and a second position spaced from the first position by a distance, the distance being adjustable as the foot section articulates, and a caster coupled to the caster support, wherein the caster support is substantially parallel to the longitudinal axis of the bed when the base has the first length and when the base has the second length.

12. The bed of claim 11, comprising an actuator coupled to the caster support, wherein the actuator is configured to extend and retract the caster support relative to the foot end of the base.

13. The bed of claim 12, wherein the deck is configured to assume a chair position and the actuator is configured to retract the caster support when the deck assumes a chair position.

14. The bed of claim 12, wherein the deck is configured to assume a horizontal position and the actuator is configured to extend the caster support when the deck assumes a horizontal position.

15. A bed, comprising a plurality of casters, a base supported by the casters, the base having a head end, a foot end spaced from the head end, and an adjustable length, a deck configured to support a mattress, the deck being supported by the base, the deck including a foot section, the foot section being movable from a first position in which the foot section is substantially parallel to the base to a second position in which the foot section is at an angle relative to the base, and a controller configured to change the length of the base if the foot section has moved, wherein the base is substantially parallel to a longitudinal axis of the bed when the foot section is in the first position and when the foot section is in the second position.

16. The bed of claim 15, wherein the controller is configured to decrease the length of the base if the foot section has moved to the second position.

17. The bed of claim 15, wherein the controller is configured to increase the length of the base if the foot section has moved to the first position.

18. A bed, comprising a plurality of casters, a base supported by the casters, the base having a head end, a foot end spaced from the head end, and an adjustable length, a deck configured to support a mattress, the deck being supported by the base, the deck including a foot section, the foot section being movable from a first position in which the foot section is substantially parallel to the base to a second position in which the foot section is at an angle relative to the base, and a controller configured to change the length of the base if the foot section has moved, a brake coupled to at least one of the casters, wherein the controller is configured to activate the brake after the length of the base is changed.

19. A bed, comprising a plurality of casters, a base supported by the casters, the base having a head end, a foot end spaced from the head end, and an adjustable length, a deck configured to support a mattress, the deck being supported by the base, the deck including a foot section, the foot section being movable from a first position in which the foot section is substantially parallel to the base to a second position in which the foot section is at an angle relative to the base, a controller configured to change the length of the base if the foot section has moved, and a foot end caster supporting the foot end of the base and a brake coupled to the foot end caster, wherein the controller is configured to release the brake before the length of the base is changed.

20. A bed, comprising a plurality of casters, a base supported by the casters, the base having a head end, a foot end spaced from the head end, and an adjustable length, a deck configured to support a mattress, the deck being supported by the base, the deck including a foot section, the foot section being movable from a first position in which the foot section is substantially parallel to the base to a second position in which the foot section is at an angle relative to the base, a controller configured to change the length of the base if the foot section has moved, and an input-output device coupled to the controller, wherein the controller is configured to receive a signal from the input-output device and change the length of the base in response to the signal.

* * * * *